United States Patent [19]

Ueda et al.

[11] Patent Number: 4,686,356

[45] Date of Patent: Aug. 11, 1987

[54] HEATING APPLIANCE WITH INTERNAL NON-VOLATILE MEMORY

[75] Inventors: Shigeki Ueda; Toyotsugu Hatagawa; Isao Kasai, all of Yamatokoriyama, Japan

[73] Assignee: Matsushita Electric Industrial Co., Ltd., Osaka, Japan

[21] Appl. No.: 827,660

[22] PCT Filed: Apr. 13, 1983

[86] PCT No.: PCT/JP83/00111

§ 371 Date: Dec. 20, 1983

§ 102(e) Date: Dec. 20, 1983

[87] PCT Pub. No.: WO83/03888

PCT Pub. Date: Nov. 10, 1983

Related U.S. Application Data

[63] Continuation of Ser. No. 567,844, Dec. 20, 1983, abandoned.

[30] Foreign Application Priority Data

May 4, 1982 [JP] Japan ..... 57-74908

[51] Int. Cl.[4] ..... H05B 6/68

[52] U.S. Cl. ..... 219/482; 219/10.55 B; 219/506; 99/325; 364/477

[58] Field of Search ..... 219/10.55 B, 10.55 R, 219/482, 490, 506, 492; 99/325; 361/86, 88, 89, 92; 307/200 A; 364/900, 400, 477

[56] References Cited

U.S. PATENT DOCUMENTS

| | | | |
|---|---|---|---|
| 4,234,920 | 11/1980 | Van Ness et al. | 307/200 A |
| 4,275,464 | 6/1981 | Schmidt | 364/477 X |
| 4,328,539 | 5/1984 | Heeger | 364/900 X |
| 4,339,646 | 7/1982 | Doi et al. | 219/10.55 B |
| 4,345,132 | 8/1982 | Takase et al. | 219/10.55 B |
| 4,349,715 | 9/1982 | Mariyama | 219/10.55 B |
| 4,394,702 | 7/1983 | Boothe | 307/200 A |
| 4,409,649 | 10/1983 | Heeger | 364/569 X |
| 4,437,159 | 3/1984 | Waugh | 219/492 X |
| 4,464,584 | 8/1984 | Hentzschel et al. | 307/200 A |

FOREIGN PATENT DOCUMENTS

| | | |
|---|---|---|
| 0027432 | 4/1981 | European Pat. Off. . |
| 49-45648 | 5/1974 | Japan . |
| 50-80020 | 6/1975 | Japan . |
| 53-25747 | 7/1978 | Japan . |
| 53-83538 | 7/1978 | Japan . |
| 53-108248 | 9/1978 | Japan . |
| 54-80467 | 6/1979 | Japan . |
| 54-84436 | 7/1979 | Japan . |
| 54-121629 | 9/1979 | Japan . |
| 55-39983 | 3/1980 | Japan . |
| 55-83945 | 6/1980 | Japan . |
| 2024455 | 9/1980 | United Kingdom . |

OTHER PUBLICATIONS

Artwick, "Microcomputer Interfacing", pp. 103–120, published by Prentice-Hall ©1980.

*Primary Examiner*—Philip H. Leung
*Attorney, Agent, or Firm*—Wenderoth, Lind & Ponack

[57] ABSTRACT

A heating appliance has a control system which is arranged such that when an internal electrically rewritable nonvolatile memory is utilized in the heating appliance for cooking foods with heat, the protection of data, an the rewriting of data and the collation of data are carried out positively and with great accuracy. A heating appliance employing such a nonvolatile memory is provided with a protection circuit for preventing the destruction of data stored in the memory when the power source is turned on and off and a main control section is provide for the periodic rewriting of memory data, whereby the data are protected against destruction and aging. Moreover, when reading the data stored in memory the collation of the data is carried out at least twice and when writing in data, the data so written is immediately read out and collated with RAM data in the main control section for improved resistance to noise.

12 Claims, 11 Drawing Figures

HEATING APPLIANCE WITH INTERNAL NON-VOLATILE MEMORY

This application is a continuation of now abandoned application Ser. No. 567,844, filed Dec. 20, 1983.

BACKGROUND OF THE INVENTION

This invention relates to a heating appliance having a home menu or user program function such that preset heating data comprising combinations of heating time, heat output, heating temperature, etc. are recalled by one touch and further comprising an electrically rewritable nonvolatile memory for storing said heating data.

There is already available a heating appliance having the so-called user program function such that preset heating data comprising combinations of heating time, heat output, heating temperature, etc. are recalled by one touch. The commercial models of this type available today may be classed into the following three major categories.

In a first system including a RAM, for example a 1-chip microcomputer (hereinafter briefly, mycon), as a main control means, heating data are stored in the built-in RAM of the mycon. While this is a simple and inexpensive system, the heating data are destroyed by a current failure.

A second system, developed to overcome the above disadvantage, is provided with a battery for backing up the memory. Although this enables backing up of the memory in a current failure, the useful life and reliability of the battery becomes a problem. Especially in the case of a heating appliance, where the ambient temperature of the mechanical compartment is fairly high, discharge of the battery is accelerated. Moreover, the system is scaled up of necessity due to the provision of a current failure detection circuit, a battery power supply switching circuit, etc., with an inevitable decrease in reliability and, of course, an addition to the manufacturing cost.

In a third system, heating data are not stored in a memory but preset in switches or volumes. Here, the home menu is stored by mechanical means so that the function is not affected by current failures. This system is advantageous from reliability point of view, too.

However, the disadvantage of the last-mentioned system is that it is not easy to operate or manipulate. Thus, there must be provided a switch or volume for each of the different menus so that the control panel is complicated. Moreover, it is procedurally difficult to preset a sequential heating pattern comprising a combination of dissimilar heat outputs or/and heating times.

SUMMARY OF THE INVENTION

Under the foregoing circumstances, the present invention, provides a heating appliance embodying a highly reliable, simple system wherein presetting of home menus is facilitated by the employment of an electrically rewritable nonvolatile memory as a means for storing heating data.

The heating appliance according to this invention is provided with a nonvolatile memory which permits electrical writing of heating data such as heating time, heat output, heating temperature, etc. and such that the heating data can be read out any time by manipulating memory keys and heating can be started by one touch. The above-mentioned nonvolatile memory is provided with a a memory refreshing procedure which rewrites the contents of the memory in the absence of a key operation within a given time period while the current supply is on, and is resistant to aging. Moreover, this nonvolatile memory is such that a double check is made at reading and a comprarison is made immediately after writing. Therefore, the memory is impervious to noise and faults. Moreover, if an error is detected at the double check or comparison, retries are made up to a predetermined number of attempts so that it features high data reliability and operability. Furthermore, the system has a self-inspection function such that the memory cells of the nonvolatile memory are inspected in accordance with a self test program.

DESCRIPTION OF THE PREFERRED EMBODIMENTS

Figure 1:
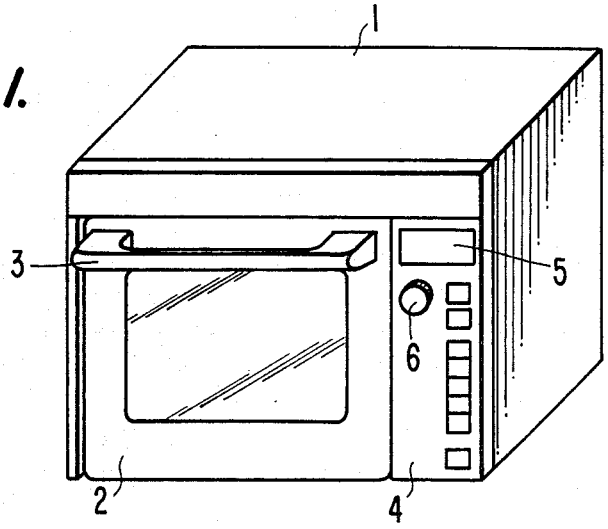
FIG. 1 is an exterior perspective view showing a heating appliance embodying the principles of this invention.

FIG. 1 is an exterior perspective view showing the heating appliance of this invention. An appliance body 1 is provided with a door means 2 at the front thereof, said door means being opened and closed by means of a handle 3. Indicated at 4 is an operation panel which has a display window 5, a timer knob 6 and various input keys.

Figure 2:
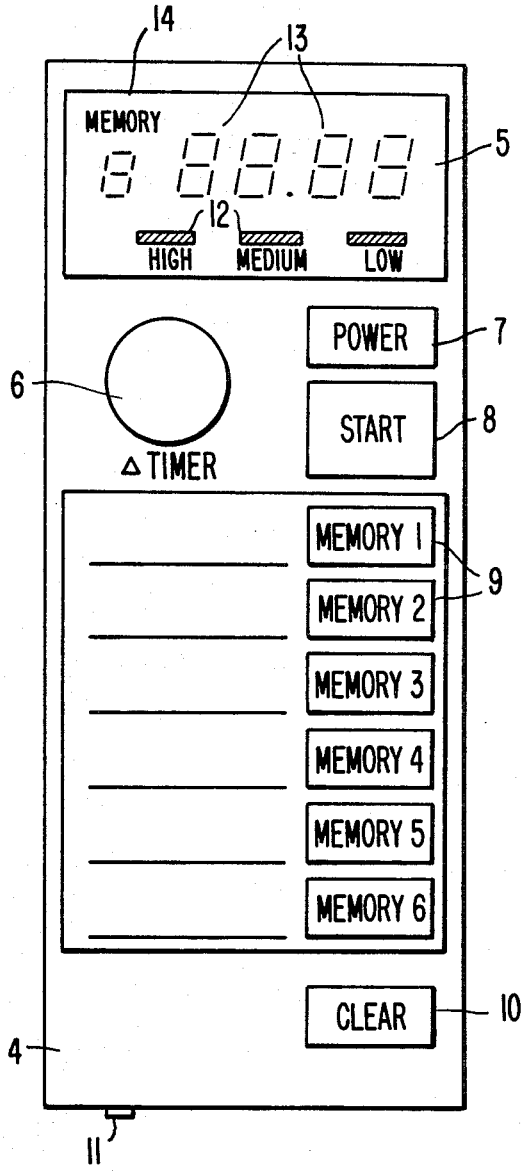
FIG. 2 is an enlarged front elevation view showing the operation panel of the same appliance.

FIG. 2 is a detailed view showing the above operation panel 4. The input keys include a power select key 7, a start key 8 for commanding the start of heating, a memory key group 9 used as a means for memory readout said means being capable of recalling six home menus, a cancellation key 10 for cancellation of settings, and, disposed at the bottom end of the control panel 4, a memory entry key 11 used as a means for writing into the memory. In order that the memory entry key 11 will not be erroneously operated so as to destroy the preset home menus, the key 11 is disposed at the bottom end of the control panel 4 instead of its surface.

In the display window 5 there appear the power display section 12 for indicating 3 stages of power, a heating time display section 13 consisting of 4-digit numeral display units and a memory display section 14 which indicates the memory number of a home menu when the menu is recalled by means of the memory key group 9.

Figure 3:
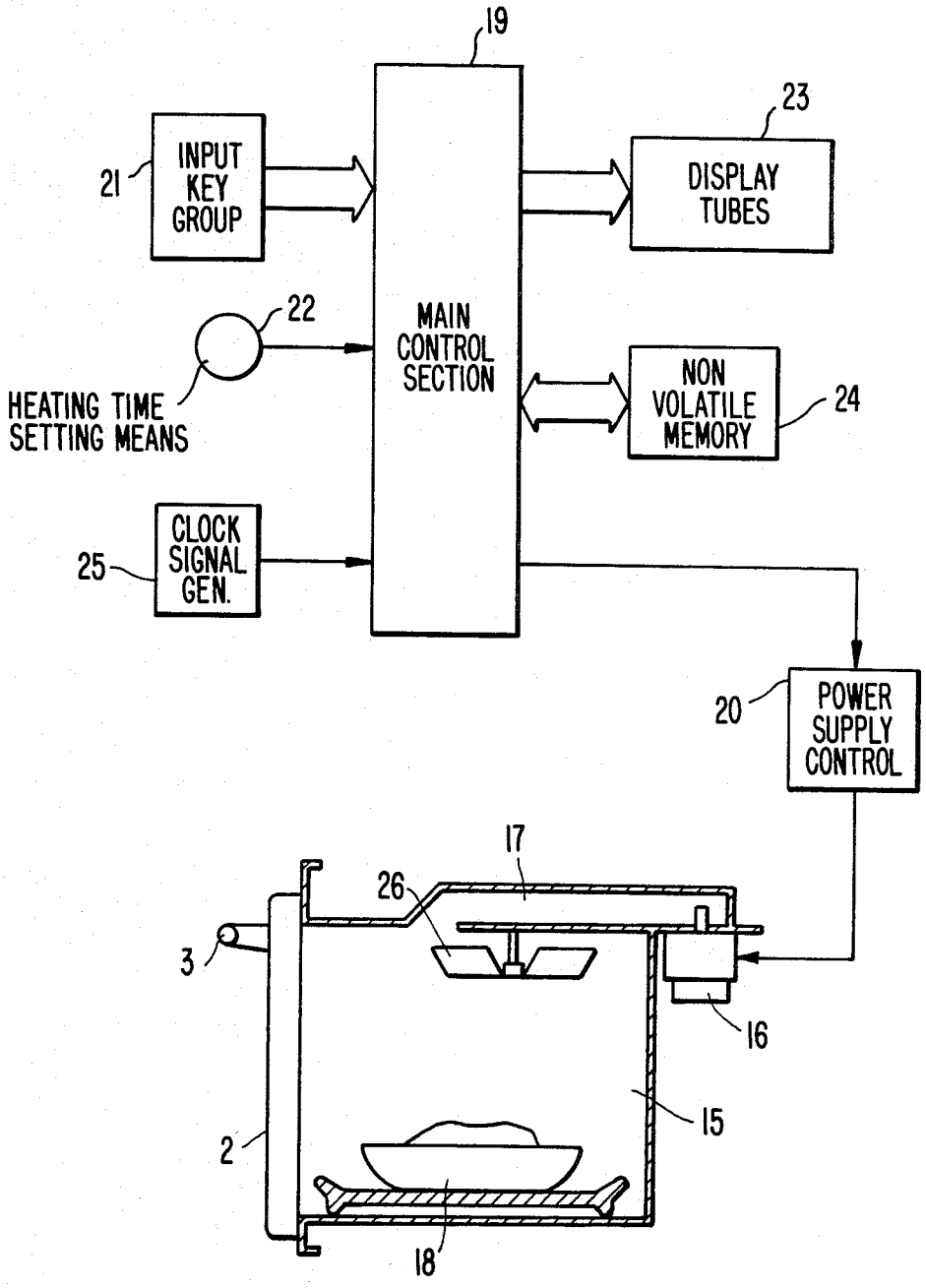
FIG. 3 is a system layout of the same appliance.

FIG. 3 is a diagrammatic view showing the system layout of such a heating appliance. An electronic range is shown as an example. Its heating chamber 15 is coupled to a magnetron 16 as a heat source via a waveguide 17 so that a heating load 18 is irradiated with microwave energy. The front opening of the heating chamber 15 is tightly fitted with a door means 2 which can be freely opened and closed with a handle 3.

A main control section 19 controls the energization of the magnetron 16 through a power supply control 20. This control is executed in accordance with the heating data inputted by the user at the input key group 21 and heating time setting means 22 associated with a timer knob 6. The reference numeral 23 means a display means which displays the above-mentioned power indication, heating time and memory number in the display window.

Indicated at 24 is a rewritable nonvolatile memory employed in accordance with this invention. The main control section 19 cause the nonvolatile memory 24 to store various home menus, allows the memory key group 9 to read them out and executes them.

The reference numeral 2, indicates a clock signal generating section generating a clock used for counting the heating time and the numeral 26 indicates a fan for stirring the electric field.

Figure 4:
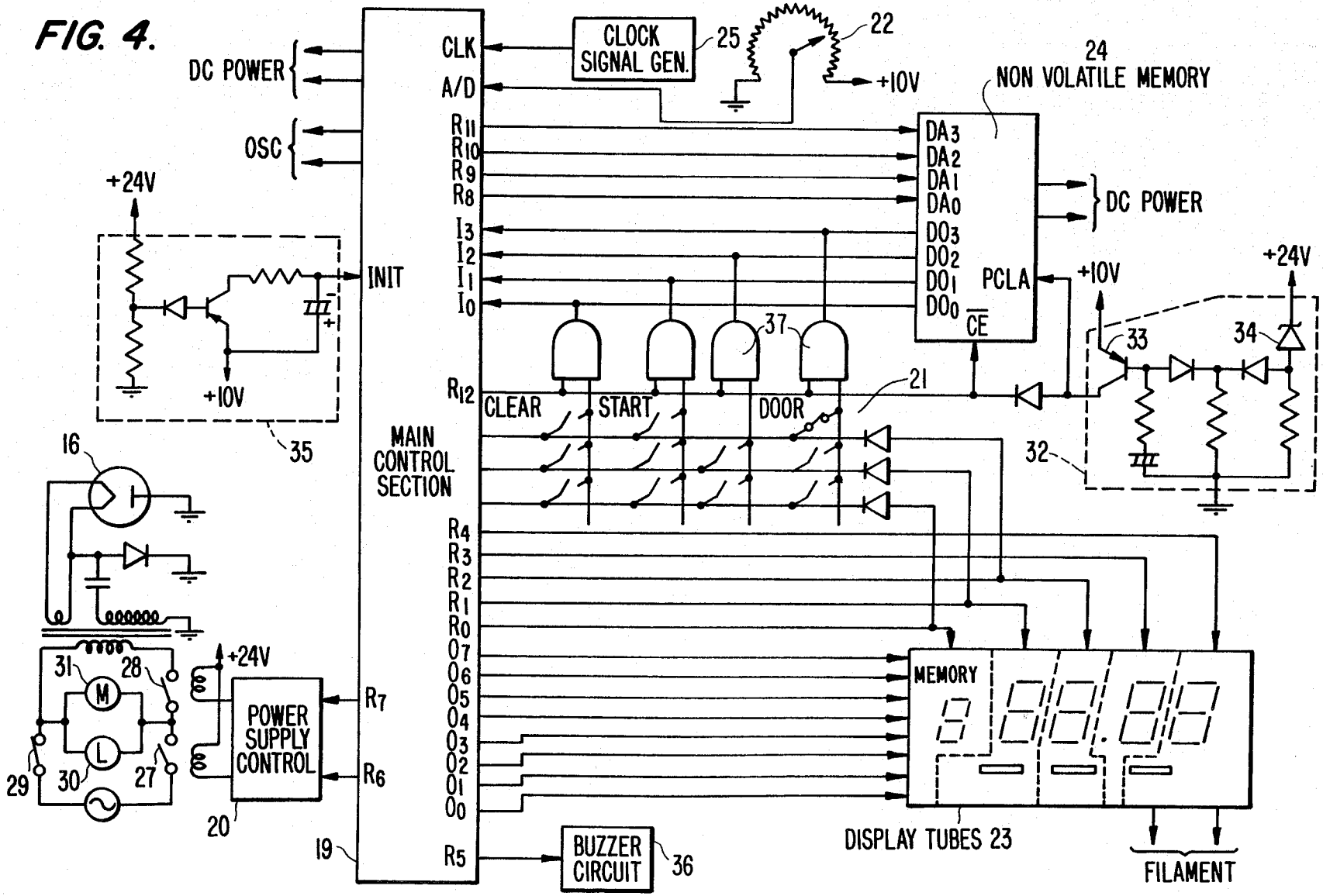
FIG. 4 is a circuit view showing the control circuit of the same appliance.

The construction of this invention has been outlined with reference to FIG. 3. Now, one embodiment of the control circuit of this invention will be described in detail. FIG. 4 is a circuit diagram of the control circuit embodying this invention. A main control section 19 comprises a stored program type controller, for example a 1-chip mycon. This mycon 19 controls the energization of the magnetron 16 through a relay driver which is a power supply control 20. A time relay 27 is a relay which continuously closes the circuit during this energization. A power relay 28 is a relay which closes the circuit intermittently during said energization and varies the average output of the magnetron 16, changing the high frequency output from one power to another in 3 stages (high, intermediate and low). Indicated at 29 is a door switch responsive to the opening and closing of the door, and an interior lamp and a motor for driving a cooling fan, etc. are shown at 30 and 31, respectively.

The mycon 19 executes power supply control in accordance with the heating data preset in its built-in RAM. The heating data are inputted into the mycon 19 9 by way of the input key group 21 and potentiometer 22 used as the heating time setting means associated with the timer knob 6 on the operation panel. The mycon 19 decodes the input instruction or data and stores the heating data in its built-in RAM. Indicated at $I_3$ to $I_0$ are input terminals, which receive key data prepared by sweeping the matrix of input key group 21 with the grid control signal of fluorescent display tubes 23 which constitutes a display means. A/D denotes the input terminal of an A/D converter and the voltage value of the potentiometer 22 is read in as a voltage value.

There are two methods of inputting heating data. One of them is a method in which desired heating data are, inputted by means of the power key 7 and timer potentiometer 22, while the other is a method in which preset heating data (home menu) are read out from the nonvolatile memory 24 by means of the memory key group 9. In the former method, the power key 7 is tapped a given number of times to select the desired high frequency output and, then, the potentiometer 22 is turned to set the desired heating time. By way of illustration, the power key 7 can be tapped in a cyclic sequence of high→intermediate→low→high . . . and, therefore, the "low" output can be selected by tapping the key twice. Then, the potentiometer 22 is turned, whereupon the varyrng voltage is read by the input terminal A/D and, after decoding into the corresponding heating time, displayed on the display tubes 23 so that the desired time may be selected. The order of manipulation of the power key and the potentiometer may be reversed and a construction that may deal with both of such arrangements can be easily implemented. This can be dealt with by the control program stored in the mycon 19.

As to the latter method, heating data can be set by one touch, i.e. by tapping the desired key in the memory key group. These heating data are previously written into the nonvolatile memory 24 by means of the memory entry key 11. The nonvolatile memory 24 may be a MNOS memory element commercially available on the market. In this embodiment, an equivalent of NM1218 (trade name) is employed.

The readout and writing of such nonvolatile memory 24 are controlled by a mode code signal and address data signals $DA_3$ through $DA_0$ from the mycon 19, whereby the desired addressing is effected. The readout data are outputted to data output terminals $DO_3$ through $DO_0$ and inputted into input terminals $I_3$ through $I_0$ of the mycon 19.

The nonvolatile memory 24 is equipped with a power on clear terminal [PCLA]similar to the initializing terminal [INIT]of the mycon 19. The memory function is enabled by setting it at a "High" level at power on and at a "Low" level after the source voltage has satisfied the operating conditions. The nonvolatile memory 24 is further provided with a chip enabling terminal [$\overline{CE}$] for driving the memory. By keeping it set at a high level, all the actions of the memory 24 can be stopped. Thus, the memory 24 can be protected so that its contents will not be destroyed. The reference numeral 32 indicates a memory protecting means for activating the PCLA and $\overline{CE}$, which protects the memory 24 when the power source is turned on and off, respectively. A transistor 33 becomes on when the power source is turned on and becomes off after charging a capacitor, whereby the memory 24 is reset. When the power source is turned off, a zener diode 34 becomes off and the transistor 33 is turned on to bring $\overline{CE}$ to a high level and thereby protect the memory 24.

The reference numeral 35 indicates an initializing circuit of the mycon 19, which resets the mycon when the power source is turned on. A clock circuit 25 generates clock pulses which are used as the base for activating the timer means of the mycon 19. The mycon 19 counts the clock pulses and performs a subtratian of heating time. Indicated at 36 is a buzzer circuit which buzzer at the completion of heating, etc.

Figure 5:
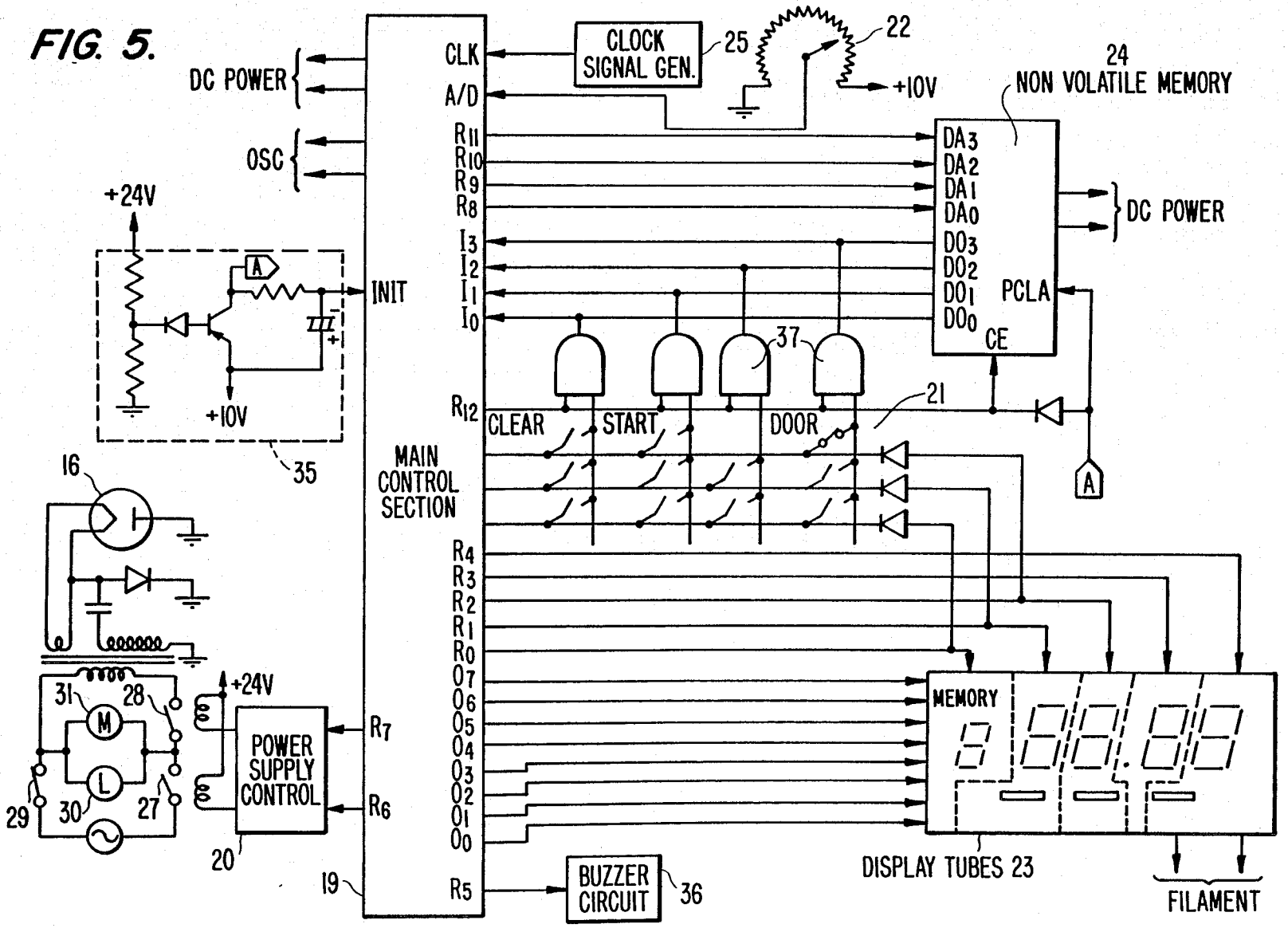
FIG. 5 is a control circuit diagram for another embodiment of this invention.

FIG. 5 shows an embodiment wherein an initializing circuit 35 of the mycon is utilized as a memory protecting means as well. The initializing circuit 35 not only initializes the mycon 19 but also resets the PCLA of the memory 24 when the power source is turned on. When the power source is turned off, the $\overline{CE}$ is forced up to the H level to protect the contents of the memory 24.

AND gate 37 switch the input to the input terminals $I_3$ through $I_0$ of the mycon 19 to a keyboard 21 and the output terminals $DO_3$ through $DO_0$ according to the $R_{12}$ output. Thus, when the $R_{12}$ output is at a high level, the input terminals $I_3$ through $I_0$ are released, for the keyboard 21 and the memory 24 is not enabled.

On the other hand, as the $R_{12}$ output becomes low, the memory 24 is enabled and the input terminals $I_3$ through $I_0$ are exclusively occupied by memory outputs $DO_3$ through $DO_0$. At this time the input data at the keyboard 21 are not inputted into the mycon 19 at all. Thus, by inhibiting the inputting of key input data during the function of the memory, it is possible to avoid the readout or writing of only part of the data due to a switching of mode in the course of reading or writing. This is especially important for writing which requires a comparatively long time, for if erroneous heating data is written into the memory, the magnetron is driven in accordance therewith and could cause an accident. Therefore, in the sense that it prevents a a mode change during the functioning of the memory, this embodiment where the key input is stopped by the gates 37 is effective.

Moreover, the mycon 19 is programmed so that the $R_{12}$ output is constantly at a high level during the heating operation. Therefore, the memory 24 cannot be read or written while microwaves are generated. This means that even if the noise derived from the microwaves is carried by the address line or output line of the memory, the contents of the memory 24 is not destroyed.

The program stored in the mycon 19 will now be explained with reference to FIGS. 6 et seq.

Figure 6:
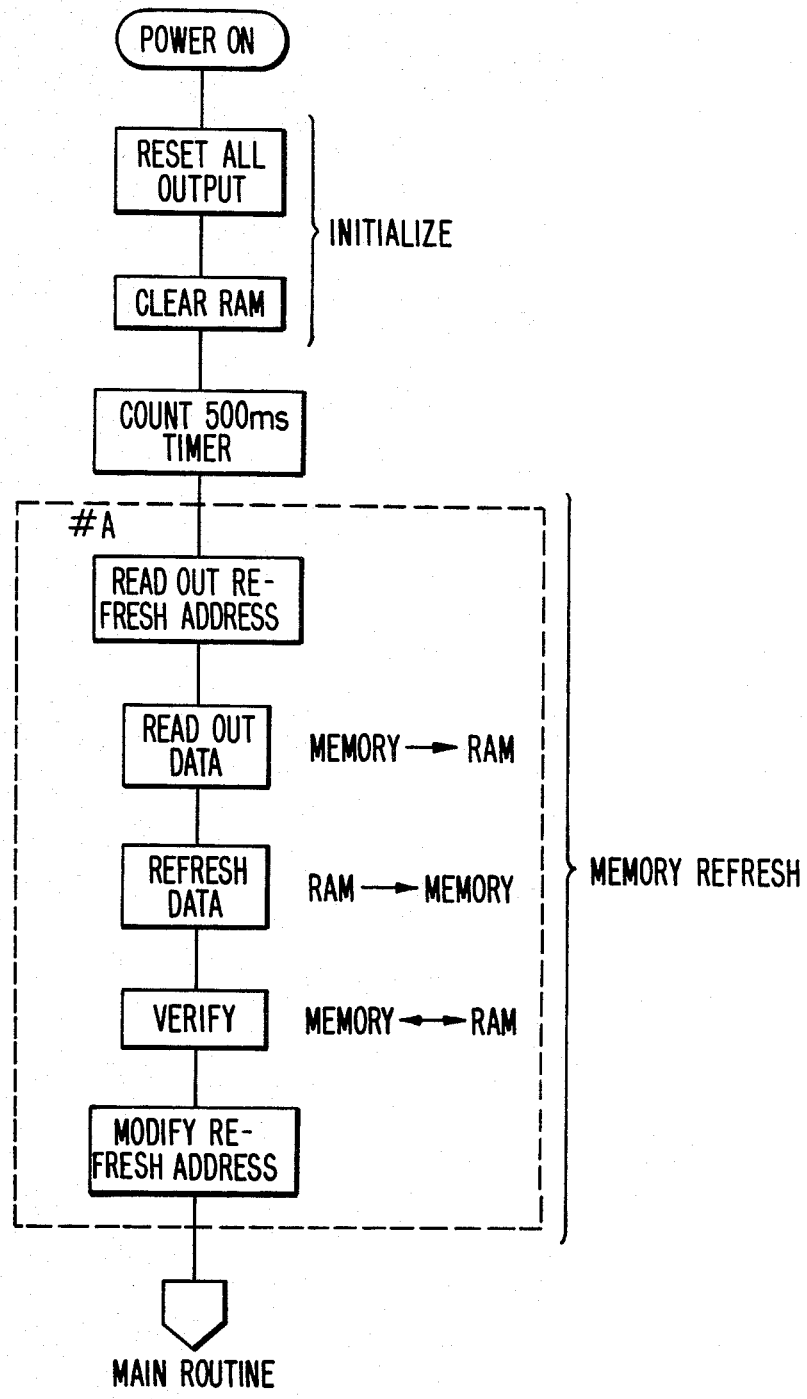
FIG. 6 is a flow chart showing the memory refreshing procedure for the mycon program used in the circuit of FIG. 4 or 5.

In FIG. 6 there is shown a flow chart showing the situation when the power source is turned on. The resetting of the INIT terminal of the mycon 19 is released, whereupon the mycon 19 starts operating. First, all the output ports are reset and, then, the RAM is cleared. This is the initialization of the mycon 19.

Then, a 500 mS timer starts counting and all the operations are delayed until 500 has passed. This is because circuit constants are selected so as to satisfy the relation of [mycon reset time]≦memory PCLA reset time]. Thus, if the resetting of the memory is released before the release of resetting of the mycon 19, the contents of the memory may be destroyed, for the output from the mycon 19 is not constant. Therefore, the mycon 19 begins to function when the memory remains protected. However, it may happen that memory access is made by the mycon 19 while the memory protection is still available. The access should fail, of course, and to prevent such a failure, a soft timer of 500 mS has been inserted. After the lapse of 500 mS, memory refreshing is carried out. Though the memory is nonvolatile, the written data is not retained permanently. Especially, when the memory is used in a fairly high temperature atmosphere, as it is the case in the mechanical compartment of a microwave oven, the memory level of data is gradually deteriorated and ultimately the written data are lost. Memory refreshing is performed to prevent occurrence of this obliteration of data. That is to say, this operation is done to rewrite the existing data so as to restore the decreasing memory level to the initial level. Memory refreshing is performed by the following procedure. First, the address to be refreshed is read out from the memory. Then, the data at the corresponding address is read out and stored in the RAM of the mycon. This data is rewritten into the same address, and data refreshing is carried out. After refreshing, a data readout and comparison are carried out again to check the memory contents against the contents of mycon RAM. Finally, the refresh address is updated to complete a memory refreshing. In this embodiment, only one address of the memory is updated when the power source is turned on. This is because refreshing requires a comparatively long time and if all the addresses be refreshed each time, the waiting time would be too long to ensure practical utility. The refresh address data are also stored in a working address of the nonlatile memory and retained even after the power source is turned off.

Figure 7:
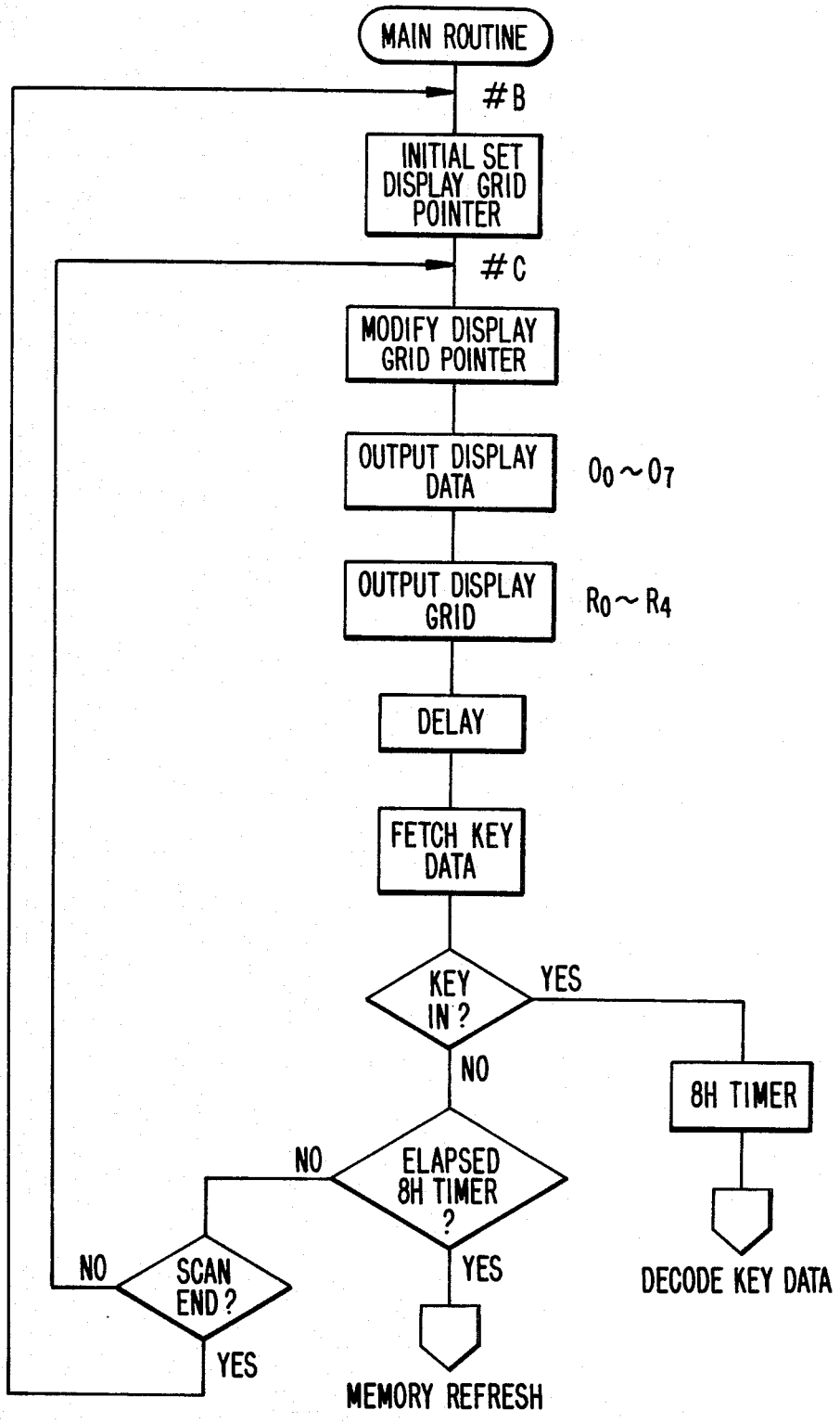
FIG. 7 is a flow chart showing another memory refreshing procedure for the same mycon program.

There also are cases in which the power source is kept on for a long time. In such cases the system shown in FIG. 6 alone is not able to perform memory refreshing. Therefore, a refreshing system of FIG. 7 has been additionally provided. FIG. 7 shows a main routine for display and key input introduction. If there is no key input for a predetermined time, memory refreshing is carried out as shown in FIG. 6.

In the embodiment shown in FIG. 7, because the display is a dynamic glow type the grid is controlled by $R_0$ to $R_4$ as illustrated in FIG. 4, the initial value is set in the display grid pointer at the leading front of scan. For example, "5" is set. Then, the value at the display grid pointer is updated. Thus, the content of the pointer is decremented. And the grid display data shown by this pointer is outputted to $O_0$ through $O_7$. This is connected to the anode of the display tube and then as the $R_n$ output is set at the grid, whereupon the given grid glows. Thereafter, with a certain delay time, data in a certain row of key matrix swept by this $R_n$ output is taken in. The key input thus taken in is checked to see if there was a key input. If there was a key input, an 8-hour timer is reset and to decode this key, a jump is made to a key decoding routine. If there was no key input, the 8-hour timer is checked and a jump is made to #C for display of the next grid. When illumination up to $R_0$ has been completed, a return to #B is made for initial setting again. And if a period of 8 hours has elapsed without no key input, it is judged that the power source has been kept on and, accordingly, a jump is made to #A (FIG. 6) for memory refreshing.

Now, a method for preventing errors in the readout of the memory with be explained.

Figure 8:
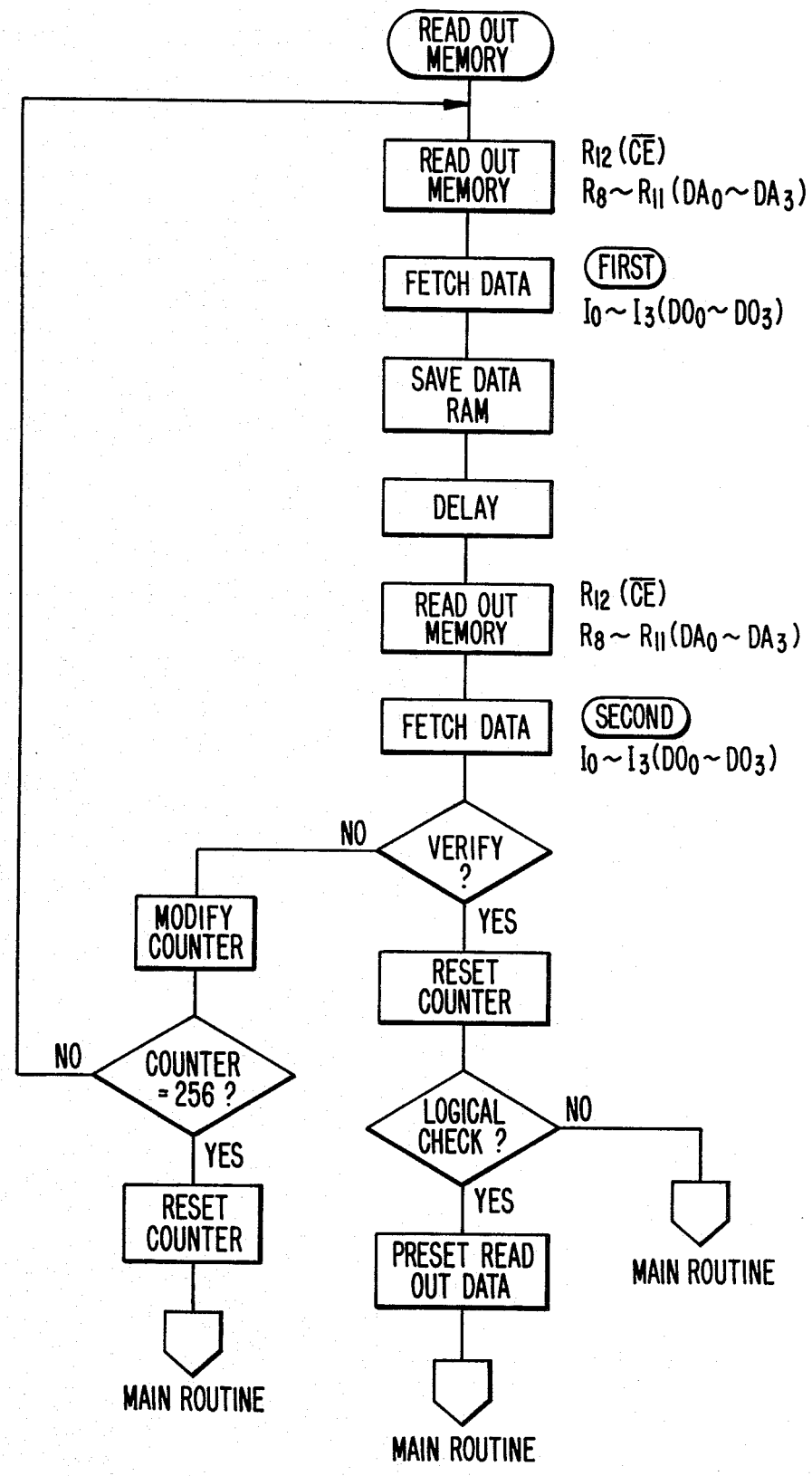
FIG. 8 is a flow chart showing the procedure for preventing errors at reading of the memory of the same mycon.

FIG. 8 shows a memory readout routine. First, a memory read mode is established with $R_8$ through $R_{11}$ and $R_{12}$ and the desired address data are preset. Then, the outputted memory data is taken in (1st) and saved in the RAM. Then, after a certain delay time, data at the very same address is re-read by the same procedure and taken in (2nd). And this data is checked against the first data saved in the RAM and if there is agreement, the readout is complete. If there is a discrepancy between the two data, it is judged that a trouble in readout has occurred due to some cause such as noise and the readout is repeated again. The counter limits the number of such repetitions and prevents formation of an endless loop of the program when the memory is faulty. In this embodiment, the number of repetitions is 256 times.

If there was an agreement between data, this 256 counter is reset and, then, a logical collation of data is carried out. This operation is done to see if the readout data is a logically possible data as heating data. More specifically, it is checked to see if the heating time data exceeds a maximum setting time, if either the power data or the heating time data is lacking, or if a value more than 6 is in digit 6 or a value over 10 is in digit 10. Of the errors due to a destruction of the memory or due to an unexpected rewriting of the memory data, the uncontrollable readout data can be eliminated by this logical comparison. And only the data which have passed this logical comparison are preset as heating data at the relevant address in the RAM.

Figure 9:
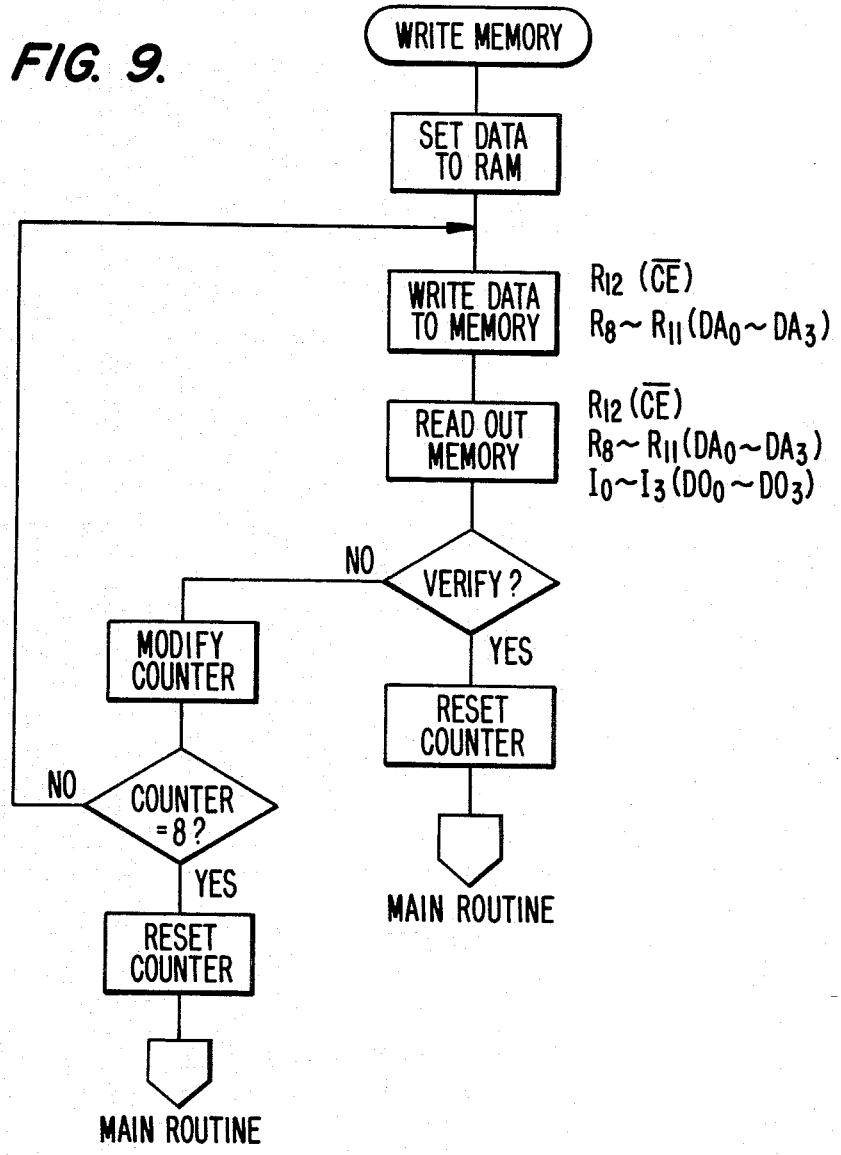
FIG. 9 is a flow chart showing the procedure for preventing errors in writing into the memory of the same mycon.

A comparison procedure for preventing errors in writing has also been additionally provided. FIG. 9 shows such a writing routine. First, the data written is set in the RAM of the mycon. Then, a memory writing mode is established with $R_8$ through $R_{11}$ and $R_{12}$ so that the desired address data and the written data are inputted into the memory. After completion of writing, the data is reread. The procedure for readout is the same as the routine shown in FIG. 8. Here, the data so read out is checked against the data set in the RAM. Thus, a check is made to see if the writing was successful or not. If the writing failed due to some error or other, up to 8 reattempts are made by the action of the counter. This small available number of attempts was selected in consideration of the fact that writing requires a longer time that does reading and the writing life of the memory is by far shorter than its reading life.

Figure 10:
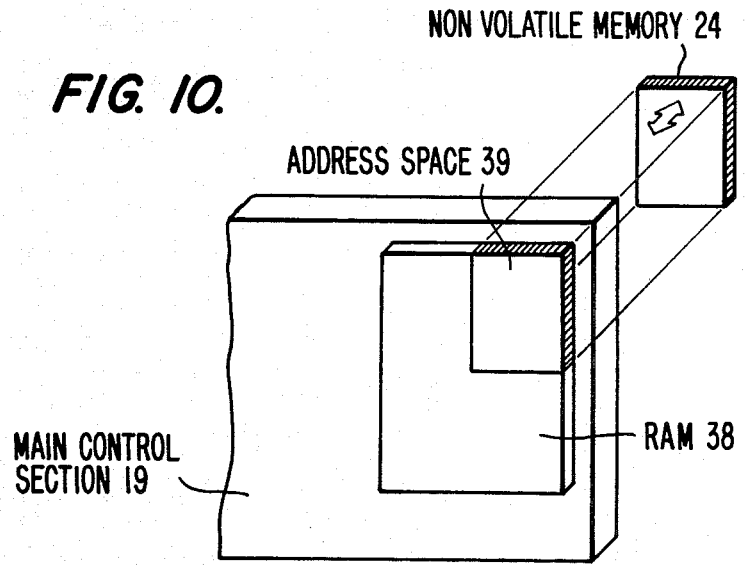
FIG. 10 is a schematic diagram showing the double-layer structure of the memory of the same mycon.

FIG. 10 shows an embodiment in which a memory map similar to the nonvolatile memory is provided in the RAM of the mycon in order to reduce the memory access time. Provided in this RAM 38 is an address space 39 corresponding to the nonvolatile memory 24 and exactly the same data is stored in both of them. The mycon 19 generally makes an access to the home menu from this address space in the RAM. And when the power source is turned on or off, the heating data is recopied from the nonvolatile memory 24 by the refreshing procedure of FIG. 6. This results in a phenomenal reduction of access time and is also expected to exert a favorable influence on the life of the memory 24.

Finally, a self test program for the memory is explained.

Figure 11:
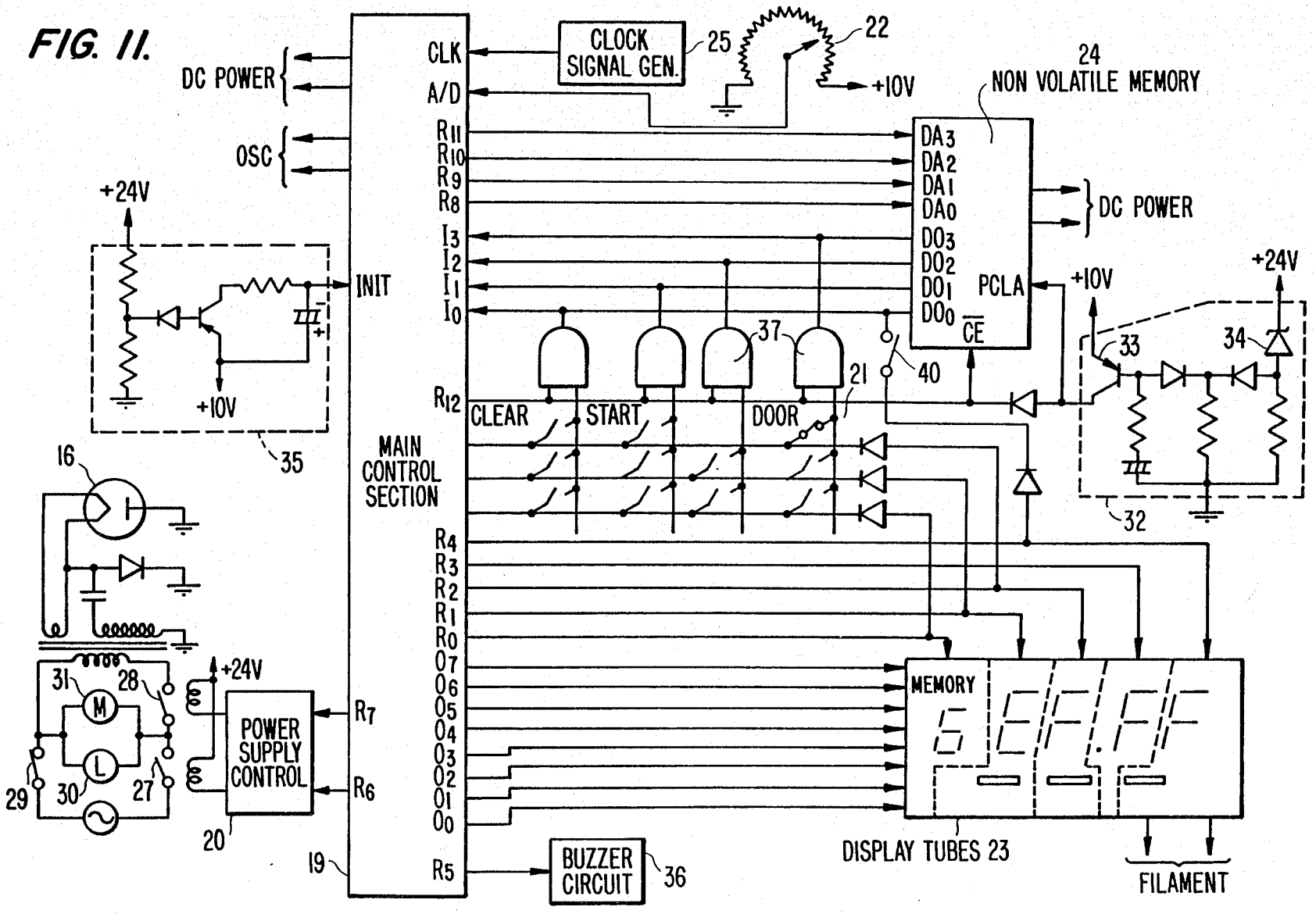
FIG. 11 is a circuit diagram showing an example of the memory self test of the same mycon.

FIG. 11 shows a circuit diagram indicating the memory test being performed. A switch 40 is a test switch for commanding the startup of the test program. This is disposed for example on the printed board and the user cannot touch it. As an execution of the test mode is instructed by this test switch 40, the mycon 19 sets and resets all the memory cells of the memory 24 to check for any faulty memory cell. More specifically, by utilizing the memory writing routine of FIG. 9 and the memory reading routine of FIG. 8, all the memory cells are set in the first place and then read out for checking. At this time the display tubes 23 indicates the display data, the numeral in [Memory] digit showing the address and the numerals in the subsequent 4 digits representing the data from the 16-bit memory cell. Therefore, if there is no abnormality in the memory, the indications of [□] to [F] appear in succession in the [Memory] digit and the indications of data read out [FFFF] follow. If the 4th bit from the top of address 6 is not set, the indication of [EFFF] is displayed as in FIG. 11 and the test is interrupted. Therefore, even the position of the faulty memory cell can be ascertained.

Then, the mycon 19 resets all the memory cells. Now, the indication of [□□□□] is sustained. If an error is detected, the test is stopped at this address and the data read out is displayed.

Thus, the memory self test program is very useful in the inspection before shipment and the market service. After the above checking, the memory returns to the blank (initial) condition.

It will be apparent from the foregoing description that in a heating appliance such as an electronic range or an electric range incorporating a nonvolatile memory this invention protects the data in the nonvolatile memory from being destroyed when the power source is turned on an off and also provides a memory refreshing procedure for rewriting the contents of the memory in the absence of a key operation during a predetermined period. Therefore, the appliance can be made useful for an extended period of time and also resistant to aging. Furthermore, since the nonvolatile memory is subjected to checking and collation at the reading and writing, it is resistant to noise and faults so that improved data reliability and operability are ensured.

We claim:

1. A heating appliance comprising a heating chamber for accepting a heating load, a heat source coupled to said heating chamber, a control section for controlling the feeding of energy to said heat source, a MNOS memory, a memory writing means for instructing the writing of heating data including heating time, heat output and/or heating temperature into said MNOS memory through an operation panel by an operator, and a memory reading means for instructing the readout of the heating data from said MNOS memory, the control section reads out the heating data from MNOS memory and rewrites the same data for confirming the stored data when the control section detects a turn on of a power source; wherein said MNOS memory operates as a non-volatile memory and wherein addressed data to be refreshed is stored at a certain address in said MNOS memory and only the heating data stored at the address corresponding to said certain address data to be refreshed is rewritten every time that a power source is turned on or when a predetermined time has passed, while the address data to be refreshed is up-dated.

2. A heating appliance as claimed in claim 1, wherein said appliance further comprises a timer means for causing the writing and reading of the MNOS memory to be inhibited during a time that the timer means is counting a predetermined delay time after the power source is turned on.

3. A heating appliance as claimed in claim 1, further comprising a memory protecting means for protecting data stored in said memory, wherein said control section inhibits at least the writing of data into said MNOS memory by said memory protecting means during a time that said heat source is energized.

4. A heating appliance as claimed in claim 1, wherein when the data from said MNOS memory is readout, the control section checks to see if the heating data so read out is logically possible and interrupts the execution of heating based on said data if the data is logically impossible.

5. A heating appliance as claimed in claim 1, wherein said control section inhibits acceptance of operation instructions from input means on the operation panel while the writing or reading of data into or out of said MNOS memory is being executed.

6. A heating appliance as claimed in claim 1, wherein after writing into the MNOS memory, said control section reads out and compares the stored data and the data in a RAM, and if there is a discrepancy between them, said control section repeats the writing, reading and comparing up to a predetermined number of times or for up to a predetermined time until an agreement is obtained.

7. A heating appliance comprising a heating chamber for accepting a heating load, a heat source coupled to said heating chamber, a control section for controlling the feeding of energy to said heat source, a MNOS memory, a memory writing means for instructing the writing of heating data including heating time, heat output and/or heating temperature into said MNOS memory through an operation panel by an operator, and a memory reading means for instructing the readout of the heating data from said MNOS memory, the control section reads out the heating data from MNOS memory and rewrites the same data for confirming the stored data; wherein said MNOS memory operates as a non-volatile memory and wherein addresssed data to be refreshed is stored at a certain address in said MNOS memory and only the heating data stored at the address corresponding to said certain address data to be refreshed is rewritten every time that a power source is turned on or when a predetermined time has passed, while the address data to be refreshed is up-dated.

8. A heating appliance as claimed in claim 7, wherein said appliance further comprises a timer means for causing the writing and reading of the MNOS memory to be inhibited during a time that the timer means is counting a predetermined delay time after the power source is turned on.

9. A heating appliance as claimed in claim 7, further comprising a memory protecting means for protecting data stored in said memory, wherein said control section inhibits at least the writing of data into said MNOS memory by said memory protecting means during a time that said heat source is energized.

10. A heating appliance as claimed in claim 7, wherein when the data from said MNOS memory is readout, the control section checks to see if the heating data so read out is logically possible and interrupts the execution of heating based on said data if the data is logically impossible.

11. A heating appliance as claimed in claim 7, wherein said control section inhibits acceptance of operation instructions from input means on the operation panel while the writing or reading of data into or out of said MNOS memory is being executed.

12. A heating appliance as claimed in claim 7, wherein after writing into the MNOS memory, said control section reads out and compares the stored data and the data in a RAM, and if there is a discrepancy between them, said control section repeats the writing, reading and comparing up to a predetermined number of times or for up to a predetermined time until an agreement is obtained.

* * * * *